US011499784B2

(12) United States Patent
Maeda et al.

(10) Patent No.: US 11,499,784 B2
(45) Date of Patent: Nov. 15, 2022

(54) HEAT EXCHANGER AND REFRIGERATION CYCLE APPARATUS

(71) Applicant: Mitsubishi Electric Corporation, Tokyo (JP)

(72) Inventors: Tsuyoshi Maeda, Tokyo (JP); Akira Yatsuyanagi, Tokyo (JP); Tomohiko Takahashi, Tokyo (JP); Yoshihide Asai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 117 days.

(21) Appl. No.: 17/265,557

(22) PCT Filed: Oct. 5, 2018

(86) PCT No.: PCT/JP2018/037331
§ 371 (c)(1),
(2) Date: Feb. 3, 2021

(87) PCT Pub. No.: WO2020/070869
PCT Pub. Date: Apr. 9, 2020

(65) Prior Publication Data

US 2021/0325117 A1 Oct. 21, 2021

(51) Int. Cl.
*F28F 1/20* (2006.01)
*F28D 1/053* (2006.01)
(Continued)

(52) U.S. Cl.
CPC ..... *F28D 1/05391* (2013.01); *F28D 21/00* (2013.01); *F28F 1/32* (2013.01); *F28D 2021/0068* (2013.01)

(58) Field of Classification Search
CPC ..... F28D 1/05391; F28D 21/00; F28D 2021/0068; F28F 1/32
(Continued)

(56) References Cited

U.S. PATENT DOCUMENTS 5,964,284 A * 10/1999 Ikejima ..... F28F 1/122 165/181
5,975,200 A * 11/1999 Kato ..... F28F 1/325 165/181
(Continued)

FOREIGN PATENT DOCUMENTS

CN 104011495 A 8/2014
EP 3091322 A1 11/2016
(Continued)

OTHER PUBLICATIONS

Office Action dated Apr. 25, 2022 issued in corresponding CN Patent Application No. 201880098021.8 (and English translation).
(Continued)

*Primary Examiner* — Davis D Hwu
(74) *Attorney, Agent, or Firm* — Posz Law Group, PLC

(57) ABSTRACT

A heat exchanger includes a plurality of fins extending along upper and lower directions, and a flat tube extending crosswise to the plurality of fins. Each of the plurality of fins has a first side edge portion and a second side edge portion, the first side edge portion and the second side edge portion extending along the upper and lower directions. The flat tube has end portions in the longitudinal axis direction of the flat tube, the end portions including a first end portion and a second end portion. The first end portion is positioned closer to the first side edge portion than the second end portion is to the first side edge portion. Each of the plurality of fins includes at least one water guide portion formed at at least one of a position between the first side edge portion and the first end portion, and a position between the second side edge portion and the second end portion, the water guide portion extending in the upper and lower directions, a lower edge portion positioned below the flat tube in the upper and lower directions, and a protruding edge portion positioned
(Continued)

below the water guide portion and protruding downwardly relative to the lower edge portion.

8 Claims, 10 Drawing Sheets

(51) Int. Cl.
*F28D 21/00* (2006.01)
*F28F 1/32* (2006.01)

(58) Field of Classification Search
USPC ..... 165/181
See application file for complete search history.

(56) References Cited

U.S. PATENT DOCUMENTS

2001/0017440 A1* 8/2001 Minamishin ..... B65H 1/14 271/147
2005/0061494 A1 3/2005 Tsuji et al.
2009/0260792 A1* 10/2009 Yalin ..... F28F 1/36 165/181
2015/0000320 A1 1/2015 Kamada et al.
2019/0383567 A1 12/2019 Maeda et al.

FOREIGN PATENT DOCUMENTS

JP H09-159314 A 6/1997
JP 2003-148889 A 5/2003
JP 2010-091145 A 4/2010
WO 2018/003123 A1 1/2018

OTHER PUBLICATIONS

International Search Report of the International Searching Authority dated Dec. 11, 2018 for the corresponding international application No. PCT/JP2018/037331 (and English translation).
Office Action dated Sep. 7, 2021, issued in corresponding JP Patent Application No. 2020-551046 (and English Machine Translation).
Extended European Search Report dated Sep. 16, 2021, issued in corresponding European Patent Application No. 18936146.2.
Office Action dated Aug. 9, 2022 issued in corresponding CN Patent Application No. 201880098021.8 (and English machine translation).

* cited by examiner

HEAT EXCHANGER AND REFRIGERATION CYCLE APPARATUS

CROSS REFERENCE TO RELATED APPLICATION

This application is a U.S. national stage application of International Application No. PCT/JP2018/037331, filed on Oct. 5, 2018, the contents of which are incorporated herein by reference.

TECHNICAL FIELD

The present disclosure relates to a heat exchanger including a plurality of fins and a flat tube extending crosswise to the plurality of fins, and to a refrigeration cycle apparatus including the same.

BACKGROUND

A parallel-flow heat exchanger is disclosed by Patent Literature 1. The heat exchanger includes a plurality of flat tubes and a plurality of fins. The lower edge of each of the fins includes an oblique part descending from the windward side toward the leeward side, and a peak part at the lowest point of the oblique part. According to Patent Literature 1, dew water or defrosting water deposited on the fin runs down to the lower edge of the fin by gravity and then drops from the peak part.

PATENT LITERATURE

Patent Literature 1: Japanese Unexamined Patent Application Publication No. 2010-91145

In the heat exchanger disclosed by Patent Literature 1, however, water may be retained at the lower edge of the fin without dropping from the peak part, depending on the balance between the weight of the water itself and surface tension. Therefore, the drainability of the heat exchanger is not necessarily improved.

SUMMARY

The present disclosure is to solve the above problem and provides a heat exchanger exhibiting improved drainability, and a refrigeration cycle apparatus including the same.

A heat exchanger according to an embodiment of the present disclosure includes a plurality of fins arranged in parallel with each other and extending along upper and lower directions; and a flat tube extending crosswise to the plurality of fins. Each of the plurality of fins has a first side edge portion and a second side edge portion, the first side edge portion and the second side edge portion extending along the upper and lower directions. The flat tube has end portions in the longitudinal axis direction of the flat tube in a cross-section perpendicular to the extending direction of the flat tube, the end portions comprising a first end portion and a second end portion, the first end portion being positioned closer to the first side edge portion than the second end portion is to the first side edge portion. Each of the plurality of fins includes at least one water guide portion formed at at least one of a position between the first side edge portion and the first end portion, and a position between the second side edge portion and the second end portion, the water guide portion extending in the upper and lower directions, a lower edge portion positioned below the flat tube in the upper and lower directions, and a protruding edge portion positioned below the water guide portion in the upper and lower directions, and protruding downwardly relative to the lower edge portion.

A refrigeration cycle apparatus according to another embodiment of the present disclosure includes the heat exchanger according to the above embodiment of the present disclosure.

According to the embodiment of the present disclosure, on each of the plurality of fins, water having run down the water guide portion and reached the protruding edge portion goes off the protruding edge portion and drops therefrom with the momentum of running down the water guide portion. Furthermore, on each of the plurality of fins, the water having run down the water guide portion to the protruding edge portion merges with water having run along the lower edge portion and reached the protruding edge portion. Consequently, the water has an increased weight at the protruding edge portion and therefore goes off the protruding edge portion more easily. Hence, in the present disclosure, water can be prevented from being retained at the lower edge portion or the protruding edge portion by surface tension. Thus, the drainability of the heat exchanger can be improved.

DETAILED DESCRIPTION

Embodiment 1

Figure 1:
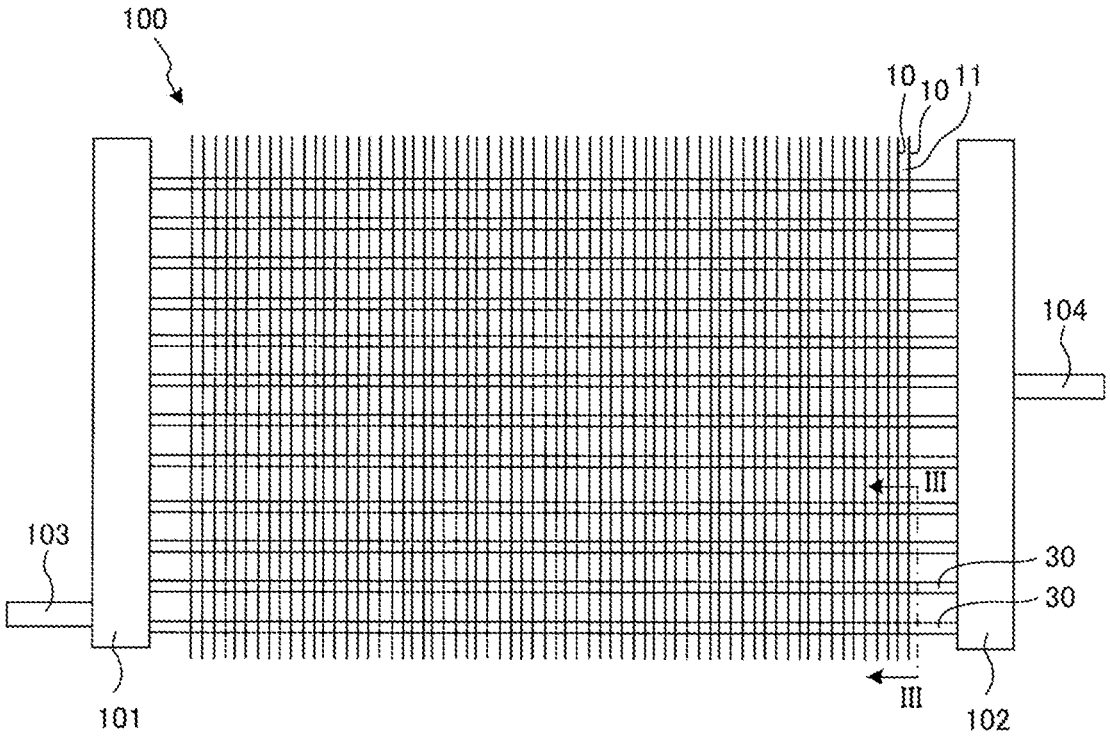
FIG. 1 is a front view illustrating a configuration of a heat exchanger 100 according to Embodiment 1 of the present disclosure.
Figure 2:
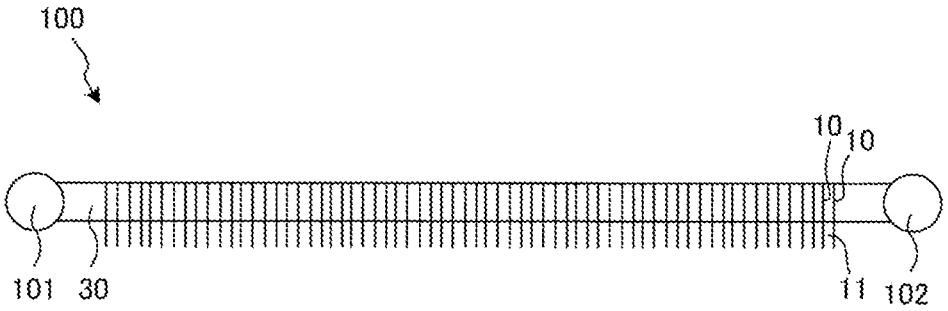
FIG. 2 is a top view illustrating the configuration of the heat exchanger 100 according to Embodiment 1 of the present disclosure.

A heat exchanger according to Embodiment 1 of the present disclosure will now be described. FIG. 1 is a front view illustrating a configuration of a heat exchanger 100 according to Embodiment 1. The upper and lower directions in FIG. 1 conform to the direction of gravity. FIG. 2 is a top view illustrating the configuration of the heat exchanger 100 according to Embodiment 1. The heat exchanger 100 is a cross-fin heat exchanger that exchanges heat between internal fluid flowing in flat tubes 30 and air supplied to the heat exchanger 100. The heat exchanger 100 is used as, for example, a heat-source-side heat exchanger or a load-side heat exchanger included in a refrigeration cycle apparatus. If the heat exchanger 100 is used in a refrigeration cycle apparatus, the internal fluid is refrigerant. The direction in which air passes through the heat exchanger 100 may be either the upper direction or the lower direction in FIG. 2. The direction of airflow will be described separately below. In the following description, the orientation of each element and the positional relationship among relevant elements are based on a state where the heat exchanger 100 is installed for use.

As illustrated in FIGS. 1 and 2, the heat exchanger 100 includes a plurality of fins 10 arranged at intervals and in parallel with each other, and a plurality of flat tubes 30 arranged in parallel with each other and extending crosswise to the plurality of fins 10.

Each of the plurality of fins has a flat rectangular shape elongated in one direction. The longitudinal direction of each of the fins 10 is parallel to the direction of gravity. That is, each of the fins 10 extends in the direction of gravity. The plurality of fins 10 are arranged in parallel with each other in the horizontal direction perpendicular to both the direction of gravity and the direction of airflow, that is, in the leftward and rightward directions in FIGS. 1 and 2. A gap 11 between adjacent ones of the fins 10 serves as an air passage through which air passes. Each of the fins 10 is made of, for example, aluminum.

Each of the plurality of flat tubes 30 extends in the horizontal direction, that is, the leftward and rightward directions in FIGS. 1 and 2. Each of the plurality of flat tubes 30 has a flat cross-sectional shape. Hereinafter, the longitudinal axis direction of the flat tubes 30 in a cross-section perpendicular to the extending direction is also simply referred to as the longitudinal axis direction of the flat tubes 30. The plurality of flat tubes 30 are arranged such that the longitudinal axis direction of the flat tubes 30 conforms to the direction of airflow. The plurality of flat tubes 30 are arranged in parallel with each other in the direction of gravity. Each of the flat tubes 30 is made of, for example, aluminum.

The heat exchanger 100 further includes a liquid header 101 and a gas header 102. One of end portions of each of the plurality of flat tubes 30 in the extending direction is connected to the liquid header 101. The other end portion of each of the plurality of flat tubes 30 in the extending direction is connected to the gas header 102. The liquid header 101 and the gas header 102 each have a cylindrical shape and extend in the upper and lower directions. The liquid header 101 has an inlet 103 serving as an inlet when the heat exchanger 100 functions as an evaporator. The inlet 103 is provided at a lower part of the liquid header 101. The gas header 102 has an outlet 104 serving as an outlet when the heat exchanger 100 functions as an evaporator. The outlet 104 is provided at a central part of the gas header 102 in the upper and lower directions.

Figure 3:
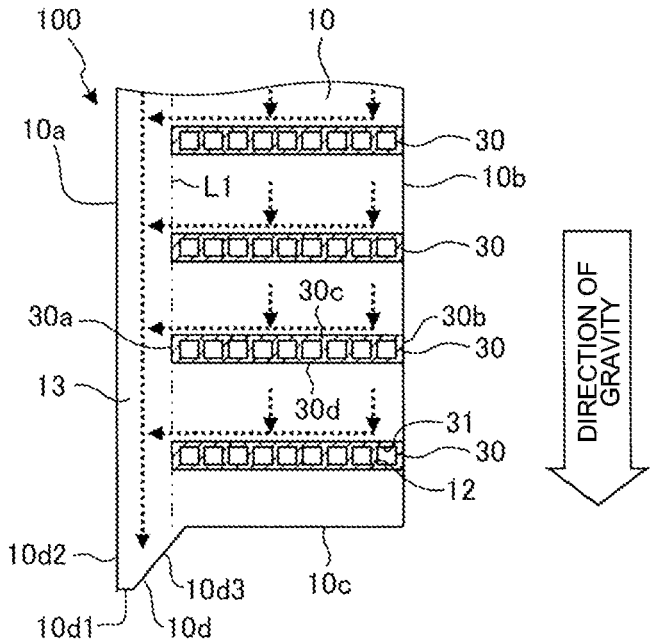
FIG. 3 is a cross-sectional view taken along line III-III illustrated in FIG. 1.

FIG. 3 is a cross-sectional view taken along line III-III illustrated in FIG. 1. The upper and lower directions in FIG. 3 conform to the direction of gravity. The longitudinal direction of each fin 10 corresponds to the upper and lower directions in FIG. 3, which conform to the direction of gravity. The widthwise direction of the fin 10 that is orthogonal to the longitudinal direction of the fin 10 corresponds to the leftward and rightward directions in FIG. 3. In Embodiment 1, the longitudinal axis direction of the flat tubes 30 also corresponds to the leftward and rightward directions in FIG. 3. The direction of airflow corresponds to the rightward or leftward direction in FIG. 3.

As illustrated in FIG. 3, each of the fins 10 has a first side edge portion 10*a* and a second side edge portion 10*b* as a pair of edge portions each extending linearly in the upper and lower directions. In the direction of airflow, one of the first side edge portion 10*a* and the second side edge portion 10*b* corresponds to the leading edge of the fin 10, and the other corresponds to the trailing edge of the fin 10. The second side edge portion 10*b* has a plurality of flat cuts 12 into which the plurality of flat tubes 30 are laterally fitted, respectively. The flat tubes 30 fitted in the cuts 12 are joined to the fin 10 by brazing or any such method.

The flat tubes 30 each have end portions in the longitudinal axis direction of the flat tube 30, the end portions including a first end portion 30*a* positioned close to the first side edge portion 10*a* of the fin 10, and a second end portion 30*b* positioned close to the second side edge portion 10*b* of the fin 10. The first end portion 30*a* is positioned closer to the first side edge portion 10*a* than the second end portion 30*b* is to the first side edge portion 10*a*. The second end portion 30*b* is positioned closer to the second side edge portion 10*b* than the first end portion 30*a* is to the second side edge portion 10*b*. The flat tube 30 has an upper surface 30*c* and a lower surface 30*d* as surfaces extending between the first end portion 30*a* and the second end portion 30*b*. The upper surface 30*c* and the lower surface 30*d* each have a flat shape. The upper surface 30*c* and the lower surface 30*d* are parallel to each other. In Embodiment 1, the flat tube 30 is oriented such that the upper surface 30*c* and the lower surface 30*d* each extend along a horizontal plane.

The second end portion 30*b* of the flat tube 30 is aligned with the second side edge portion 10*b* of the fin 10. In contrast, the first end portion 30*a* of the flat tube 30 does not reach the first side edge portion 10*a* of the fin 10. The flat tube 30 has a plurality of fluid passages 31 through which the internal fluid is allowed to flow. The plurality of fluid passages 31 are arranged between the first end portion 30*a* and the second end portion 30*b* and in parallel with each other in the longitudinal axis direction of the flat tube 30. Each of the fluid passages 31 extends in the extending direction of the flat tube 30.

The fin 10 includes a water guide portion 13 on each of the front and back surfaces thereof between the first side edge portion 10*a* and the first end portions 30*a* of the flat tubes 30. The water guide portion 13 has a band shape extending in the upper and lower directions. The water guide portion 13 forms a linear passage that downwardly guides water deposited on the surface of the fin 10 or the surfaces of the flat tubes 30. The water guide portion 13 has, for example, a flat shape not to hinder water from flowing. The water guide portion 13 illustrated in FIG. 3 is a band-shaped area between the first side edge portion 10*a* and a line L1 passing through the first end portions 30*a* of the plurality of flat tubes 30.

The fin 10 further includes a lower edge portion 10*c* positioned below the flat tubes 30. The lower edge portion 10*c* forms a part of the outer edge of the fin 10. The lower edge portion 10*c* forms a linear line perpendicular to the first side edge portion 10*a* and the second side edge portion 10*b* and parallel to the widthwise direction of the fin 10. The fin 10 is oriented such that the lower edge portion 10*c* extends along a horizontal plane.

The fin 10 further includes a protruding edge portion 10*d* positioned below the water guide portion 13. The protruding edge portion 10*d* forms a part of the outer edge of the fin 10. The protruding edge portion 10*d* adjoins the lower edge portion 10*c* and protrudes downwardly relative to the lower edge portion 10*c*. That is, the protruding edge portion 10*d* protrudes downwardly relative to the extension of the lower edge portion 10*c*. The protruding edge portion 10*d* is at a lower position than the lower edge portion 10*c*. The protruding edge portion 10*d* is positioned right below the water guide portion 13.

The protruding edge portion 10*d* has, for example, a trapezoidal or triangular shape. The protruding edge portion 10*d* has a bottom edge 10*d*1 positioned at the lower end of the protruding edge portion 10*d*, a first side edge 10*d*2 positioned between the first side edge portion 10*a* and the bottom edge 10*d*1, and a second side edge 10*d*3 positioned between the lower edge portion 10*c* and the bottom edge 10*d*1. The bottom edge 10*d*1 forms, for example, a linear line perpendicular to the first side edge portion 10*a*. The fin 10 is oriented such that the bottom edge 10*d*1 extends along a horizontal plane. The first side edge 10*d*2 forms, for example, a linear line as an extension of the first side edge portion 10*a*. The second side edge 10*d*3 forms, for example, a linear line inclined relative to the first side edge portion 10*a*. The inclination of the second side edge 10*d*3 relative to a horizontal plane is greater than the inclination of the lower edge portion 10*c* relative to a horizontal plane. In the example illustrated in FIG. 3, the bottom edge 10*d*1, the first side edge 10*d*2, and the second side edge 10*d*3 are all linear. Alternatively, at least one of the bottom edge 10*d*1, the first side edge 10*d*2, and the second side edge 10*d*3 may be curved. Moreover, the second side edge 10*d*3 and the lower edge portion 10*c* may together form a smooth continuous curve.

When the heat exchanger 100 functions as an evaporator, water in the air is condensed and is deposited as condensed water on the surfaces of the fins 10 and the flat tubes 30. Furthermore, when frost deposited on the heat exchanger 100 melts in a defrosting operation or any such operation, the melted frost is deposited as melted water on the surfaces of the fins 10 and the flat tubes 30. In FIG. 3, the flow of such water is exemplified by broken-line arrows. For example, water deposited on the surface of the fin 10 in an area between adjacent two of the flat tubes 30 gradually runs down the surface of the fin 10 and reaches the upper surface 30*c* of the lower one of the two flat tubes 30. The water having reached the upper surface 30*c* or water deposited on the upper surface 30*c* moves along the upper surface 30*c* and reaches the water guide portion 13. Then, the water runs down the water guide portion 13. Such streams of water deposited in different areas of the fin 10 sequentially merge together in the water guide portion 13. Therefore, the amount of water running down the water guide portion 13 increases toward the lower side of the water guide portion 13. Accordingly, the speed of water running down the water guide portion 13 increases toward the lower side of the water guide portion 13. That is, water runs down the water guide portion 13 with a gradually increasing momentum.

The water having run down the water guide portion 13 reaches the protruding edge portion 10*d* positioned below the water guide portion 13. The water having run down the water guide portion 13 to the protruding edge portion 10*d* merges with water having run along the lower edge portion 10*c* and reached the protruding edge portion 10*d*. Then, with the momentum of running down the water guide portion 13, the water goes off the bottom edge 10*d*1 and drops therefrom.

Now, the direction of airflow in the heat exchanger 100 will be described. As described above, the direction of airflow may be either the rightward or leftward direction, which is one of the leftward and rightward directions in FIG. 3. Considering the reduction in the amount of frost to be deposited on the heat exchanger 100, the direction of airflow is desired to be the rightward direction in FIG. 3. Such an aspect will further be described. In the configuration illustrated in FIG. 3, the flat tubes 30 are aligned with the second side edge portion 10*b* of the fin 10. Hence, when the heat exchanger 100 functions as an evaporator, the temperature of the first side edge portion 10*a* is higher than the temperature of the second side edge portion 10*b*. If the direction of airflow is the rightward direction in FIG. 3, the temperature of the first side edge portion 10*a* as the leading edge of the fin 10 can be made close to the temperature of the air to be taken in. Therefore, if the direction of airflow is the rightward direction in FIG. 3, the amount of frost to be deposited on the heat exchanger 100 can be reduced.

On the other hand, considering a further improvement in the drainability of the heat exchanger 100, the direction of airflow is desired to be the leftward direction in FIG. 3. This is because the water deposited on the surface of the fin 10 or the flat tube 30 in such a situation is more easily guided toward the water guide portion 13 by the airflow.

Figure 4:
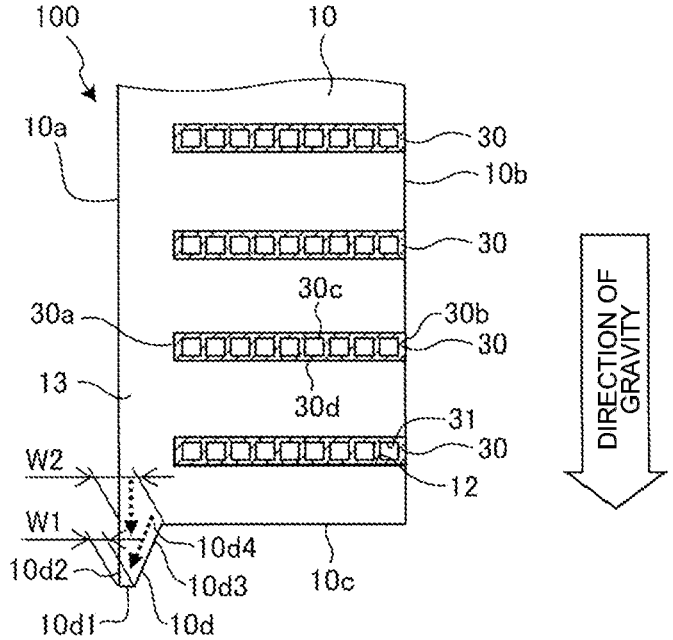
FIG. 4 is a cross-sectional view illustrating a relevant part of a heat exchanger 100 according to Example 1 of Embodiment 1 of the present disclosure.

Now, exemplary configurations of the heat exchanger 100 according to Embodiment 1 will be described. FIG. 4 is a cross-sectional view illustrating a relevant part of a heat exchanger 100 according to Example 1 of Embodiment 1. FIG. 4 and FIGS. 5, 6, 8 to 14, 18, and 20 to be referred to below each illustrate a cross-section corresponding to the cross-section illustrated in FIG. 3. In the heat exchanger 100 illustrated in FIG. 4, the width of the bottom edge 10*d*1 positioned at the lower end of the protruding edge portion 10*d* is denoted by W1, and the width of a base part 10*d*4 positioned at the upper end of the protruding edge portion 10*d* is denoted by W2. The widths W1 and W2 are both a dimension in the widthwise direction of the fin 10. Here, the width W1 is smaller than or equal to the width W2 (W1≤W2). The width W1 of the bottom edge 10*d*1 is substantially 0 if the protruding edge portion 10*d* has a triangular shape and greater than 0 if the protruding edge portion 10*d* has a trapezoidal shape.

Figure 5:
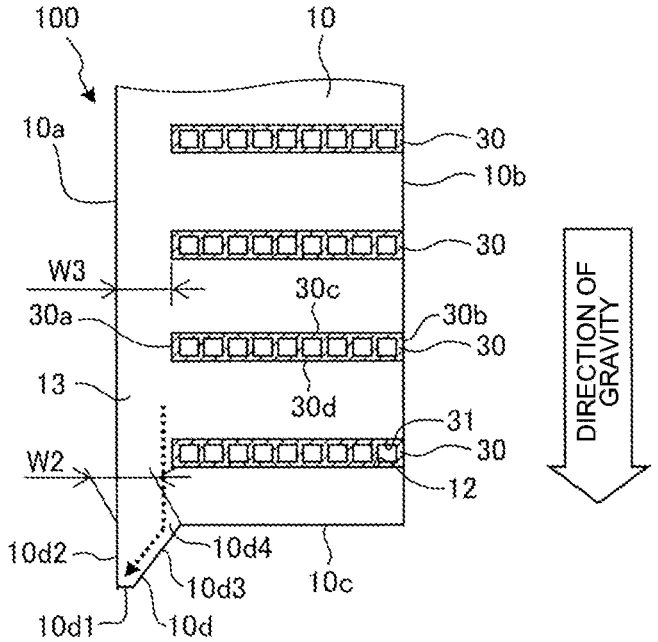
FIG. 5 is a cross-sectional view illustrating a relevant part of a heat exchanger 100 according to Example 2 of Embodiment 1 of the present disclosure.

FIG. 5 is a cross-sectional view illustrating a relevant part of a heat exchanger 100 according to Example 2 of Embodiment 1. In the heat exchanger 100 illustrated in FIG. 5, the width of the water guide portion 13, that is, the width between the first side edge portion 10*a* and each of the first end portions 30*a*, is denoted by W3. The width W3 is a dimension in the widthwise direction of the fin 10. Here, the width W3 is smaller than or equal to the width W2 (W3≤W2).

As described above, the heat exchanger 100 according to Embodiment 1 includes the plurality of fins 10 arranged in parallel with each other and extending along the upper and lower directions, and the flat tubes 30 extending crosswise to the plurality of fins 10. Each of the plurality of fins 10 has the first side edge portion 10*a* and the second side edge portion 10*b*, the first side edge portion 10*a* and the second side edge portion 10*b* extending along the upper and lower directions. Each of the flat tubes 30 has end portions in the longitudinal axis direction of the flat tube 30 in a cross-section perpendicular to the extending direction of the flat tube 30, the end portions including the first end portion 30*a* and the second end portion 30*b*. The first end portion 30*a* is positioned closer to the first side edge portion 10*a* than the second end portion 30*b* is to the first side edge portion 10*a*. Each of the plurality of fins 10 includes the water guide portion 13 extending in the upper and lower directions, the lower edge portion 10*c* positioned below the flat tubes 30 in the upper and lower directions, and a protruding edge portion 10*d* positioned below the water guide portion 13 in the upper and lower directions and protruding downwardly relative to the lower edge portion 10*c*. The water guide portion 13 is formed at at least one of a position between the first side edge portion 10*a* and the first end portions 30*a*, and a position between the second side edge portion 10*b* and the second end portions 30*b*.

In such a configuration, water having run down the water guide portion 13 and reached the protruding edge portion 10*d* goes off the protruding edge portion 10*d* and drops therefrom with the momentum of running down the water guide portion 13. Furthermore, the water having run down the water guide portion 13 to the protruding edge portion 10*d* merges with water having run along the lower edge portion 10*c* and reached the protruding edge portion 10*d*. Consequently, the water having gathered at the protruding edge portion 10*d* has an increased weight and therefore goes off the protruding edge portion 10*d* more easily. Hence, in Embodiment 1, water can be prevented from being retained at the lower edge portion 10*c* or the protruding edge portion 10*d* by surface tension. Thus, the drainability of the heat exchanger 100 can be improved.

In the heat exchanger 100 according to Embodiment 1, letting the width of the protruding edge portion 10*d* at the lower end thereof be W1 and the width of the protruding edge portion 10*d* at the upper end thereof be W2, a relationship of W1≤W2 is satisfied. In such a configuration, water in a wide area extending in the widthwise direction of the fin 10 can be gathered at the lower end of the protruding edge portion 10*d*. Therefore, the weight of the water itself gathered at the protruding edge portion 10*d* can be increased. Consequently, the water can go off the protruding edge portion 10*d* more easily. Thus, the drainability of the heat exchanger 100 can be improved further.

In the heat exchanger 100 according to Embodiment 1, letting the width of the protruding edge portion 10*d* at the upper end thereof be W2 and the width of the water guide portion 13 be W3, a relationship of W3≤W2 is satisfied. In such a configuration, water running down the water guide portion 13 can be made to reach the protruding edge portion 10*d* more assuredly. Therefore, the drainability of the heat exchanger 100 can be improved further. In addition, it is more desirable that a relationship of W3<W2 be satisfied. If the relationship of W3<W2 is satisfied, water running down the first end portion 30*a* of the lowest one of the flat tubes 30 and deflected toward the lower surface 30*d* can also be made to reach the protruding edge portion 10*d* more assuredly.

Embodiment 2

Figure 6:
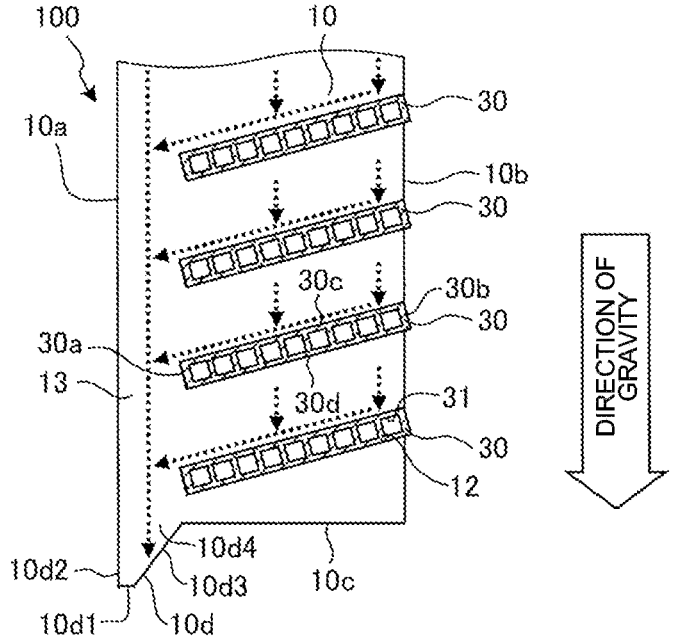
FIG. 6 is a cross-sectional view illustrating a relevant part of a heat exchanger 100 according to Embodiment 2 of the present disclosure.

A heat exchanger according to Embodiment 2 of the present disclosure will now be described. FIG. 6 is a cross-sectional view illustrating a relevant part of a heat exchanger 100 according to Embodiment 2. Elements having the same functions and effects as those described in Embodiment 1 are denoted by corresponding ones of the reference signs used therein, and description of such elements is omitted. As illustrated in FIG. 6, each of the plurality of flat tubes 30 is oriented such that the upper surface 30*c* and the lower surface 30*d* thereof are inclined relative to a horizontal plane. For each of the plurality of flat tubes 30, the position of the upper surface 30*c* at the first end portion 30*a* is lower than the position of the upper surface 30*c* at the second end portion 30*b*. Furthermore, for each of the plurality of flat tubes 30, the position of the lower surface 30*d* at the first end portion 30*a* is lower than the position of the lower surface 30*d* at the second end portion 30*b*. Thus, each of the upper surface 30*c* and the lower surface 30*d* is inclined by descending toward the water guide portion 13.

Condensed water or melted water deposited on the fin 10 in an area between adjacent two of the flat tubes 30 gradually runs down the surface of the fin 10 and reaches the upper surface 30*c* of the lower one of the two flat tubes 30. The water having reached the upper surface 30*c* or water deposited on the upper surface 30*c* runs down the inclined upper surface 30*c* toward the water guide portion 13 and further runs down the water guide portion 13. The water having run down the water guide portion 13 and reached the protruding edge portion 10*d* merges with water having run along the lower edge portion 10*c* and reached the protruding edge portion 10*d*. Then, with the momentum of running down the water guide portion 13, the water goes off the bottom edge 10*d*1 and drops therefrom.

In Embodiment 2, the direction of airflow may be either the rightward or leftward direction in FIG. 6. Considering the reduction in the amount of frost to be deposited on the heat exchanger 100, the direction of airflow is desired to be the rightward direction in FIG. 6. Considering a further improvement in the drainability of the heat exchanger 100, the direction of airflow is desired to be the leftward direction in FIG. 6.

As described above, in the heat exchanger 100 according to Embodiment 2, the flat tube 30 has a flat upper surface 30*c*. The upper surface 30*c* is inclined by descending toward the water guide portion 13. In such a configuration, water runs down the upper surface 30*c* toward the water guide portion 13. Therefore, the momentum of the water running down the water guide portion 13 can be increased. Consequently, the water can go off the protruding edge portion 10*d* more easily. Thus, the drainability of the heat exchanger 100 can be improved further.

Embodiment 3

Figure 7:
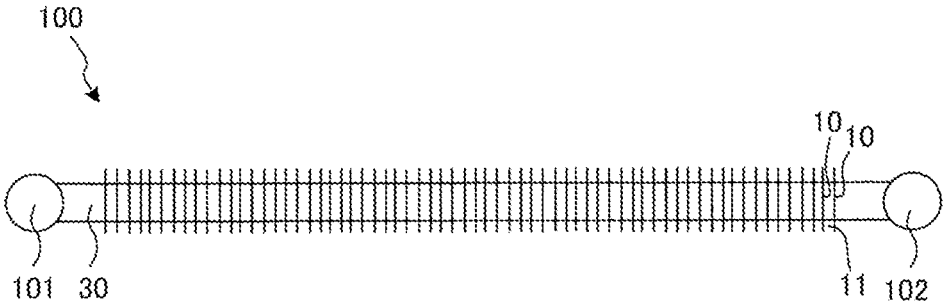
FIG. 7 is a top view illustrating a configuration of a heat exchanger 100 according to Embodiment 3 of the present disclosure.
Figure 8:
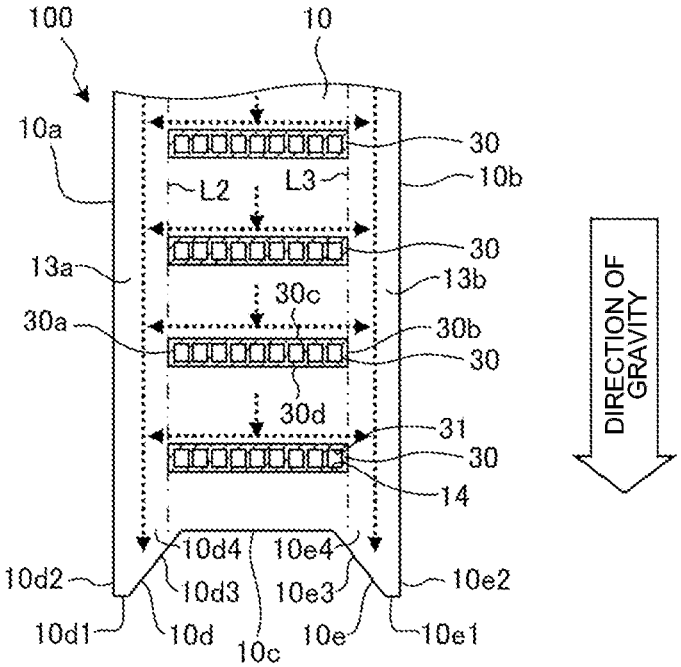
FIG. 8 is a cross-sectional view illustrating a relevant part of the heat exchanger 100 according to Embodiment 3 of the present disclosure.

A heat exchanger according to Embodiment 3 of the present disclosure will now be described. FIG. 7 is a top view illustrating a configuration of a heat exchanger 100 according to Embodiment 3. FIG. 8 is a cross-sectional view illustrating a relevant part of the heat exchanger 100 according to Embodiment 3. Elements having the same functions and effects as those described in Embodiment 1 or 2 are denoted by corresponding ones of the reference signs used therein, and description of such elements is omitted. As illustrated in FIGS. 7 and 8, each of the plurality of fins 10 has a plurality of flat through-holes 14 in a central part thereof in the widthwise direction. The through-holes 14 allow the plurality of flat tubes 30 to extend therethrough, respectively. The flat tubes 30 extending through the through-holes 14 are joined to the fin 10 by brazing or any such method. The flat tubes 30 are each oriented such that the upper surface 30*c* and the lower surface 30*d* extend along a horizontal plane.

The fin 10 has a first water guide portion 13*a* on each of the front and back surfaces thereof between the first side edge portion 10*a* and the first end portions 30*a* of the flat tubes 30. The first water guide portion 13*a* has a band shape extending in the upper and lower directions. Furthermore, the fin 10 has a second water guide portion 13*b* on each of the front and back surfaces thereof between the second side edge portion 10*b* and the second end portions 30*b* of the flat tubes 30. The second water guide portion 13*b* has a band shape extending in the upper and lower directions. The first water guide portion 13*a* and the second water guide portion 13*b* each form a linear passage that downwardly guides water deposited on the surface of the fin 10 or the surfaces of the flat tubes 30. The first water guide portion 13*a* and the second water guide portion 13*b* each have, for example, a flat shape not to hinder water from flowing. The first water guide portion 13*a* illustrated in FIG. 8 is a band-shaped area between the first side edge portion 10*a* and a line L2 passing through the first end portions 30*a* of the plurality of flat tubes 30. The second water guide portion 13*b* illustrated in FIG. 8 is a band-shaped area between the second side edge portion 10*b* and a line L3 passing through the second end portions 30*b* of the plurality of flat tubes 30.

The fin 10 includes a lower edge portion 10*c* positioned below the flat tubes 30, a protruding edge portion 10*d* positioned below the first water guide portion 13*a*, and a protruding edge portion 10*e* positioned below the second water guide portion 13*b*. The protruding edge portion 10*d* is an example of the first protruding edge portion. The protruding edge portion 10*e* is an example of the second protruding edge portion. The lower edge portion 10*c*, the protruding edge portion 10*d*, and the protruding edge portion 10*e* each form a part of the outer edge of the fin 10. The protruding edge portion 10*d* and the protruding edge portion 10*e* each adjoin the lower edge portion 10*c* and protrude downwardly relative to the lower edge portion 10*c*. That is, the protruding edge portion 10*d* and the protruding edge portion 10*e* protrude downwardly relative to the extension of the lower edge portion 10*c*. The protruding edge portion 10*d* and the protruding edge portion 10*e* are at lower positions than the lower edge portion 10*c*. The protruding edge portion 10*d* and the protruding edge portion 10*e* are provided on both sides of the lower end of the fin 10 with the lower edge portion 10*c* in between. The protruding edge portion 10*d* and the protruding edge portion 10*e* have respective trapezoidal or triangular shapes that are in bilateral symmetry. The protruding edge portion 10*d* is positioned right below the first water guide portion 13*a*. The protruding edge portion 10*e* is positioned right below the second water guide portion 13*b*.

The protruding edge portion 10*d* has a bottom edge 10*d*1 positioned at the lower end of the protruding edge portion 10*d*, a first side edge 10*d*2 positioned between the first side edge portion 10*a* and the bottom edge 10*d*1, and a second side edge 10*d*3 positioned between the lower edge portion 10*c* and the bottom edge 10*d*1. The protruding edge portion 10*e* has a bottom edge 10*e*1 positioned at the lower end of the protruding edge portion 10*e*, a first side edge 10*e*2 positioned between the second side edge portion 10*b* and the bottom edge 10*e*1, and a second side edge 10*e*3 positioned between the lower edge portion 10*c* and the bottom edge 10*e*1.

Condensed water or melted water deposited on the fin 10 in an area between adjacent two of the flat tubes 30 gradually runs down the surface of the fin 10 and reaches the upper surface 30*c* of the lower one of the two flat tubes 30. The water having reached the upper surface 30*c* or water deposited on the upper surface 30*c* moves along the upper surface 30*c* and reaches one of the first water guide portion 13*a* and the second water guide portion 13*b*. Then, the water runs down the one of the water guide portions 13*a* and 13*b*. Such streams of water deposited in different areas of the fin 10 sequentially merge together in each of the first water guide portion 13*a* and the second water guide portion 13*b*. Therefore, the amount of water running down each of the first water guide portion 13*a* and the second water guide portion 13*b* increases toward the lower side. Accordingly, the speed of water running down each of the first water guide portion 13*a* and the second water guide portion 13*b* increases toward the lower side. That is, water runs down the first water guide portion 13*a* and the second water guide portion 13*b* with a gradually increasing momentum.

The water having run down the first water guide portion 13*a* reaches the protruding edge portion 10*d* positioned below the first water guide portion 13*a*. The water having run down the first water guide portion 13*a* and reached the protruding edge portion 10*d* merges with water having run along the lower edge portion 10*c* and reached the protruding edge portion 10*d*. Then, with the momentum of running down the first water guide portion 13*a*, the water goes off the bottom edge 10*d*1 and drops therefrom. On the other hand, the water having run down the second water guide portion 13*b* reaches the protruding edge portion 10*e* positioned below the second water guide portion 13*b*. The water having run down the second water guide portion 13*b* and reached the protruding edge portion 10*e* merges with water having run along the lower edge portion 10*c* and reached the protruding edge portion 10*e*. Then, with the momentum of running down the second water guide portion 13*b*, the water goes off the bottom edge 10*e*1 and drops therefrom. Hence, in Embodiment 3, water can be prevented from being retained at the lower edge portion 10*c*, the protruding edge portion 10*d*, or the protruding edge portion 10*e* by surface tension. Thus, the drainability of the heat exchanger 100 can be improved.

The fin 10 according to Embodiment 3 has a bilaterally symmetrical configuration in the leftward and rightward directions in FIG. 8. Therefore, the direction of airflow may be either the rightward or leftward direction in FIG. 8.

Figure 9:
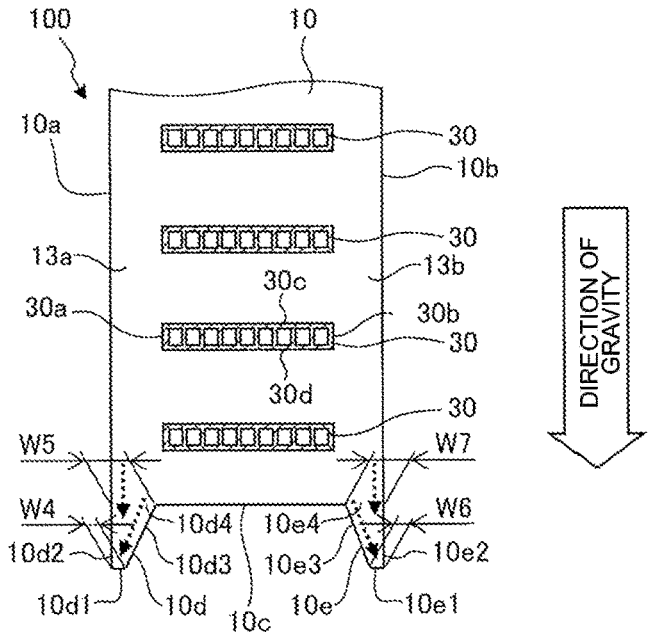
FIG. 9 is a cross-sectional view illustrating a relevant part of a heat exchanger 100 according to Example 1 of Embodiment 3 of the present disclosure.

Now, exemplary configurations of the heat exchanger 100 according to Embodiment 3 will be described. FIG. 9 is a cross-sectional view illustrating a relevant part of a heat exchanger 100 according to Example 1 of Embodiment 3. In the heat exchanger 100 illustrated in FIG. 9, the width of the bottom edge 10*d*1 positioned at the lower end of the protruding edge portion 10*d* is denoted by W4, and the width of the base part 10*d*4 positioned at the upper end of the protruding edge portion 10*d* is denoted by W5. The widths W4 and W5 are each a dimension in the widthwise direction of the fin 10. Here, the width W4 is smaller than or equal to the width W5 (W4≤W5). Furthermore, the width of the bottom edge 10*e*1 positioned at the lower end of the protruding edge portion 10*e* is denoted by W6, and the width of a base part 10*e*4 positioned at the upper end of the protruding edge portion 10*e* is denoted by W7. The widths W6 and W7 are each a dimension in the widthwise direction of the fin 10. Here, the width W6 is smaller than or equal to the width W7 (W6≤W7). In such a configuration, water in a wide area extending in the widthwise direction can be gathered at each of the lower ends of the protruding edge portion 10*d* and the protruding edge portion 10*e*. Therefore, the weight of the water itself gathered at each of the protruding edge portion 10*d* and the protruding edge portion 10*e* can be increased. Consequently, the water can go off each of the protruding edge portion 10*d* and the protruding edge portion 10*e* more easily. Thus, the drainability of the heat exchanger 100 can be improved further.

Figure 10:
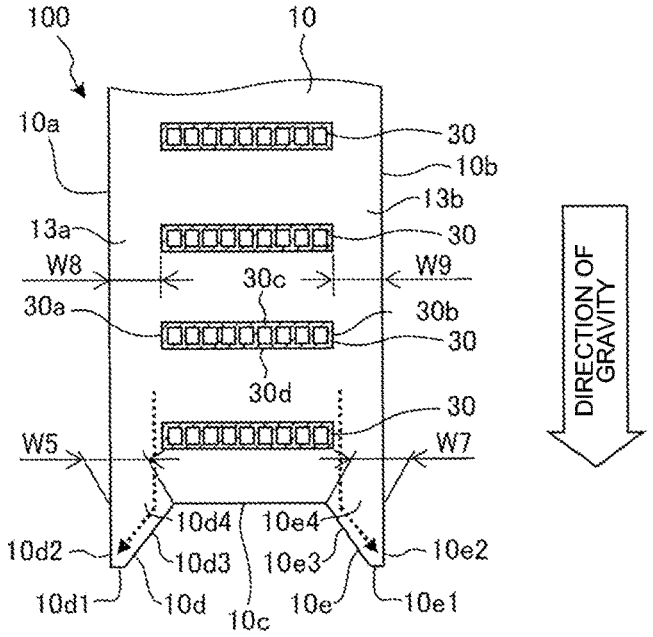
FIG. 10 is a cross-sectional view illustrating a relevant part of a heat exchanger 100 according to Example 2 of Embodiment 3 of the present disclosure.

FIG. 10 is a cross-sectional view illustrating a relevant part of a heat exchanger 100 according to Example 2 of Embodiment 3. In the heat exchanger 100 illustrated in FIG. 10, the width of the first water guide portion 13*a*, that is, the width between the first side edge portion 10*a* and each of the first end portions 30*a*, is denoted by W8. The width W8 is a dimension in the widthwise direction of the fin 10. Here, the width W8 is smaller than or equal to the width W5 (W8≤W5). Furthermore, the width of the second water guide portion 13*b*, that is, the width between the second side edge portion 10*b* and each of the second end portions 30*b*, is denoted by W9. The width W9 is a dimension in the widthwise direction of the fin 10. Here, the width W9 is smaller than or equal to the width W7 (W9≤W7). In such a configuration, water running down the first water guide portion 13*a* can be made to reach the protruding edge portion 10*d* more assuredly, and water running down the second water guide portion 13*b* can be made to reach the protruding edge portion 10*e* more assuredly. Thus, the drainability of the heat exchanger 100 can be improved further. In addition, it is more desirable that relationships of W8<W5 and W9<W7 be satisfied. In such a case, water running down the first end portion 30*a* or the second end portion 30*b* of the lowest one of the flat tubes 30 and deflected toward the lower surface 30*d* can also be made to reach the protruding edge portion 10*d* or the protruding edge portion 10*e* more assuredly.

Embodiment 4

Figure 11:
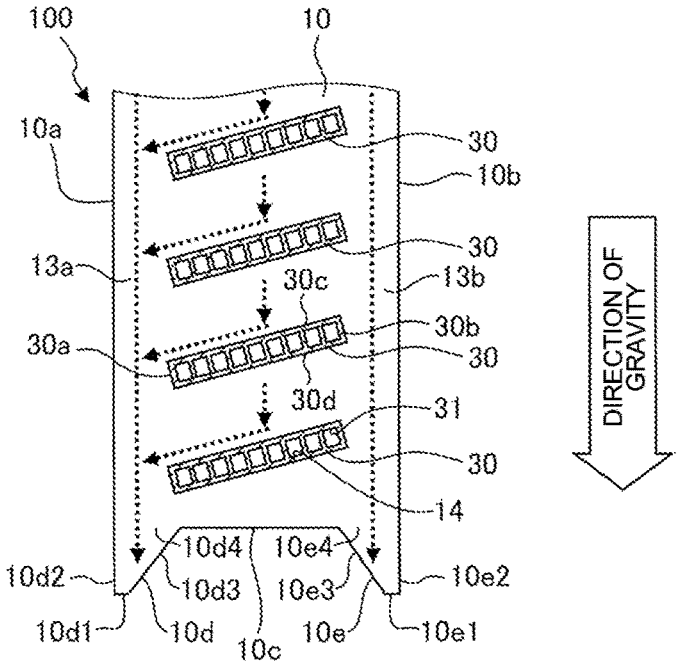
FIG. 11 is a cross-sectional view illustrating a relevant part of a heat exchanger 100 according to Embodiment 4 of the present disclosure.

A heat exchanger according to Embodiment 4 of the present disclosure will now be described. FIG. 11 is a cross-sectional view illustrating a relevant part of a heat exchanger 100 according to Embodiment 4. Elements having the same functions and effects as those described in any of Embodiments 1 to 3 are denoted by corresponding ones of the reference signs used therein, and description of such elements is omitted. As illustrated in FIG. 11, each of the plurality of flat tubes 30 is oriented such that the upper surface 30*c* and the lower surface 30*d* thereof are inclined relative to a horizontal plane. The position of the upper surface 30*c* at the first end portion 30*a* is lower than the position of the upper surface 30*c* at the second end portion 30*b*. The position of the lower surface 30*d* at the first end portion 30*a* is lower than the position of the lower surface 30*d* at the second end portion 30*b*. Thus, each of the upper surface 30*c* and the lower surface 30*d* is inclined by descending toward the first water guide portion 13*a*.

Condensed water or melted water deposited on the fin 10 in an area between adjacent two of the flat tubes 30 gradually runs down the surface of the fin 10 and reaches the upper surface 30*c* of the lower one of the two flat tubes 30. The water having reached the upper surface 30*c* or water deposited on the upper surface 30*c* runs down the inclined upper surface 30*c* toward the first water guide portion 13*a* and further runs down the first water guide portion 13*a*. The water having run down the first water guide portion 13*a* and reached the protruding edge portion 10*d* merges with water having run along the lower edge portion 10*c* and reached the protruding edge portion 10*d*. Then, with the momentum of running down the first water guide portion 13*a*, the water goes off the bottom edge 10*d*1 and drops therefrom. On the other hand, water deposited on the second water guide portion 13*b* runs down the second water guide portion 13*b* and drops from the bottom edge 10*e*1 of the protruding edge portion 10*e*. Hence, in Embodiment 4, water can be prevented from being retained at the lower edge portion 10*c*, the protruding edge portion 10*d*, or the protruding edge portion 10*e* by surface tension. Thus, the drainability of the heat exchanger 100 can be improved.

In Embodiment 4, the direction of airflow is desired to be the leftward direction in FIG. 11. If the direction of airflow is the leftward direction, the flow of water along the upper surface 30*c* toward the first water guide portion 13*a* is promoted by the flow of the air. Therefore, the drainability of the heat exchanger 100 can be improved further.

Figure 12:
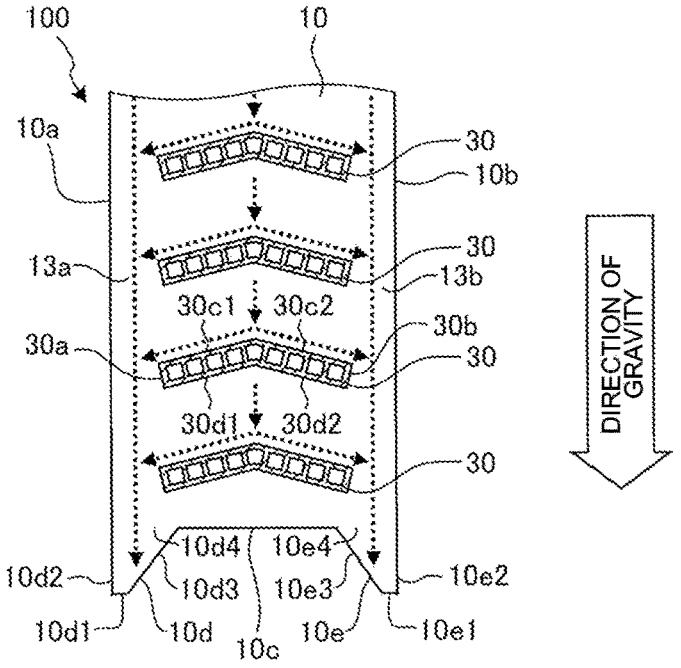
FIG. 12 is a cross-sectional view illustrating a relevant part of a heat exchanger 100 according to a modification of Embodiment 4 of the present disclosure.

FIG. 12 is a cross-sectional view illustrating a relevant part of a heat exchanger 100 according to a modification of Embodiment 4. As illustrated in FIG. 12, in the present modification, the plurality of flat tubes 30 each have an inverted-V cross-sectional shape by being bent at a central part in the longitudinal axis direction thereof.

The upper surface of each of the flat tubes 30 includes a flat upper surface 30*c*1 adjoining the first end portion 30*a*, that is, positioned close to the first water guide portion 13*a*; and a flat upper surface 30*c*2 adjoining the second end portion 30*b*, that is, positioned close to the second water guide portion 13*b*. The upper surface 30*c*1 is inclined by descending toward the first water guide portion 13*a*. On the other hand, the upper surface 30*c*2 is inclined by descending toward the second water guide portion 13*b*, opposite to the way of inclination of the upper surface 30*c*1.

The lower surface of each of the flat tubes 30 includes a flat lower surface 30*d*1 positioned close to the first water guide portion 13*a*, and a flat lower surface 30*d*2 positioned close to the second water guide portion 13*b*. The lower surface 30*d*1 is inclined by descending toward the first water guide portion 13*a*. The lower surface 30*d*2 is inclined by descending toward the second water guide portion 13*b*, opposite to the way of inclination of the lower surface 30*d*1.

Water having reached the upper surface 30*c*1 or water deposited on the upper surface 30*c*1 runs down the inclined upper surface 30*c*1 toward the first water guide portion 13*a* and then runs down the first water guide portion 13*a*. The water having run down the first water guide portion 13*a* and reached the protruding edge portion 10*d* merges with water having run along the lower edge portion 10*c* and reached the protruding edge portion 10*d*. Then, with the momentum of running down the first water guide portion 13*a*, the water goes off the bottom edge 10*d*1 and drops therefrom. On the other hand, water having reached the upper surface 30*c*2 or water deposited on the upper surface 30*c*2 runs down the inclined upper surface 30*c*2 toward the second water guide portion 13*b* and then runs down the second water guide portion 13*b*. The water having run down the second water guide portion 13*b* and reached the protruding edge portion 10*e* merges with water having run along the lower edge portion 10*c* and reached the protruding edge portion 10*e*. Then, with the momentum of running down the second water guide portion 13*b*, the water goes off the bottom edge 10*e*1 and drops therefrom. Hence, in the present modification as well, water can be prevented from being retained at the lower edge portion 10*c*, the protruding edge portion 10*d*, or the protruding edge portion 10*e* by surface tension. Thus, the drainability of the heat exchanger 100 can be improved.

Embodiment 5

Figure 13:
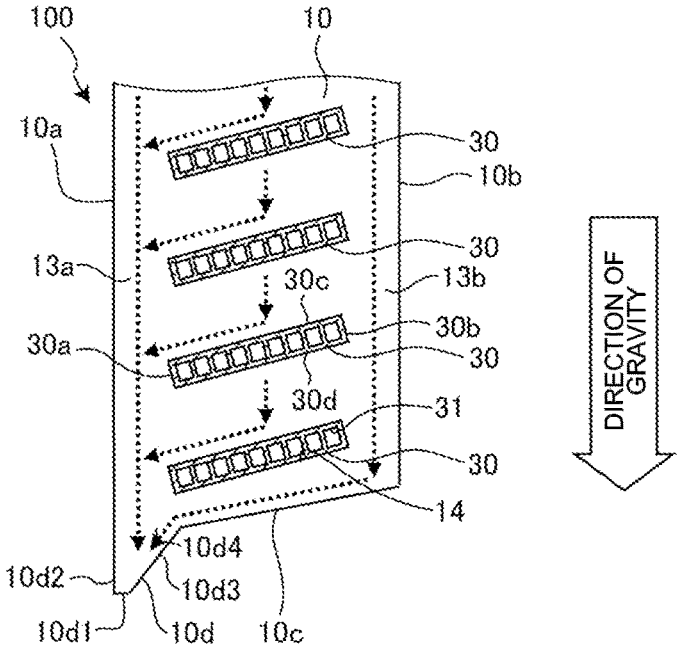
FIG. 13 is a cross-sectional view illustrating a relevant part of a heat exchanger 100 according to Embodiment 5 of the present disclosure.

A heat exchanger according to Embodiment 5 of the present disclosure will now be described. FIG. 13 is a cross-sectional view illustrating a relevant part of a heat exchanger 100 according to Embodiment 5. Elements having the same functions and effects as those described in any of Embodiments 1 to 4 are denoted by corresponding ones of the reference signs used therein, and description of such elements is omitted. As illustrated in FIG. 13, in Embodiment 5, the lower edge portion 10*c* reaches a position below the second water guide portion 13*b*. Therefore, in Embodiment 5, the protruding edge portion 10*e* positioned below the second water guide portion 13*b* is omitted. The lower edge portion 10*c* is inclined such that the position thereof close to the first side edge portion 10*a* is lower than the position thereof close to the second side edge portion 10*b*. That is, the lower edge portion 10*c* is inclined by descending toward the protruding edge portion 10*d* positioned below the first water guide portion 13*a*. In other words, the lower edge portion 10*c* according to Embodiment 5 is inclined in the same way as the upper surface 30*c* and the lower surface 30*d* of the flat tube 30 are inclined.

Water deposited on the second water guide portion 13*b* runs down the second water guide portion 13*b*. The water having run down the second water guide portion 13*b* drops from the lower edge portion 10*c* with the momentum thereof or is guided along the lower edge portion 10*c* toward the protruding edge portion 10*d*, merges with water having run down the first water guide portion 13*a*, and drops from the protruding edge portion 10*d*. Hence, in Embodiment 5, water can be prevented from being retained at the lower edge portion 10*c* or the protruding edge portion 10*d* by surface tension. Thus, the drainability of the heat exchanger 100 can be improved.

In Embodiment 5, the direction of airflow is desired to be the leftward direction in FIG. 13. If the direction of airflow is the leftward direction, the flow of water along the upper surface 30*c* toward the first water guide portion 13*a* and the flow of water along the lower edge portion 10*c* toward the protruding edge portion 10*d* are promoted by the flow of the air. Therefore, the drainability of the heat exchanger 100 can be improved further.

As described above, in the heat exchanger 100 according to Embodiment 5, the water guide portion includes the first water guide portion 13*a* provided between the first side edge portion 10*a* and the first end portions 30*a*, and the second water guide portion 13*b* provided between the second side edge portion 10*b* and the second end portions 30*b*. The flat tubes 30 each have a flat upper surface 30*c*. The upper surface 30*c* is inclined by descending toward one of the first water guide portion 13*a* and the second water guide portion 13*b*. The protruding edge portion 10*d* is provided below the one of the first water guide portion 13*a* and the second water guide portion 13*b*. The lower edge portion 10*c* reaches a position below the other of the first water guide portion 13*a* and the second water guide portion 13*b*. The lower edge portion 10*c* is inclined by descending toward the protruding edge portion 10*d*. In such a configuration, water can be prevented from being retained at the lower edge portion 10*c* or the protruding edge portion 10*d* by surface tension. Thus, the drainability of the heat exchanger 100 can be improved.

Embodiment 6

Figure 14:
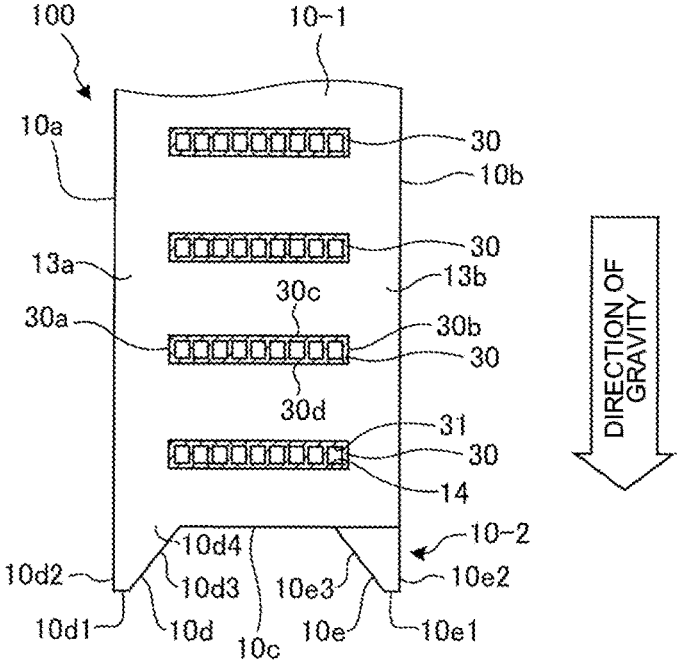
FIG. 14 is a cross-sectional view illustrating a relevant part of a heat exchanger 100 according to Embodiment 6 of the present disclosure.

A heat exchanger according to Embodiment 6 of the present disclosure will now be described. FIG. 14 is a cross-sectional view illustrating a relevant part of a heat exchanger 100 according to Embodiment 6. Here, one of the plurality of fins 10 is denoted as a first fin 10-1, and another one adjacent to the first fin 10-1 at an interval is denoted as a second fin 10-2. In the direction in which the plurality of fins 10 are arranged in parallel with each other, first fins 10-1 and second fins 10-2 are arranged alternately. Elements having the same functions and effects as those described in any of Embodiments 1 to 5 are denoted by corresponding ones of the reference signs used therein, and description of such elements is omitted.

As illustrated in FIG. 14, the first fins 10-1 each have the same shape as the fin 10 according to Embodiment 3 illustrated in FIG. 8, except that the protruding edge portion 10*e* below the second water guide portion 13*b* is omitted. The lower edge portion 10*c* of the first fin 10-1 reaches a position below the second water guide portion 13*b*. The lower edge portion 10*c* of the first fin 10-1 extends along a horizontal plane or is inclined by descending toward the protruding edge portion 10*d*.

On the other hand, the second fins 10-2 each have the same shape as the fin 10 according to Embodiment 3 illustrated in FIG. 8, except that the protruding edge portion 10*d* below the first water guide portion 13*a* is omitted. The lower edge portion 10*c* of the second fin 10-2 reaches a position below the first water guide portion 13*a* of the second fin 10-2. The lower edge portion 10*c* of the second fin 10-2 extends along a horizontal plane or is inclined by descending toward the protruding edge portion 10*e*, opposite to the way of inclination of the lower edge portion 10*c* of the first fin 10-1.

In Embodiment 6, the direction of airflow may be either the rightward or leftward direction in FIG. 14.

As described above, in the heat exchanger 100 according to Embodiment 6, the plurality of fins 10 include the first fins 10-1 and the second fins 10-2, the second fins 10-2 each being adjacent to a corresponding one of the first fins 10-1 at an interval. The water guide portion includes the first water guide portion 13*a* provided between the first side edge portion 10*a* and the first end portions 30*a*, and the second water guide portion 13*b* provided between the second side edge portion 10*b* and the second end portions 30*b*. The protruding edge portion 10*d* of the first fin 10-1 is provided below one of the first water guide portion 13*a* and the second water guide portion 13*b*. The protruding edge portion 10*e* of the second fin 10-2 is provided below the other of the first water guide portion 13*a* and the second water guide portion 13*b*.

In such a configuration, the interval between adjacent ones of the protruding edge portions 10*d* in the direction of parallel arrangement of the plurality of fins 10 can be increased to approximately twice the interval between adjacent ones of the fins 10. Accordingly, the surface tension of the water that is present between adjacent ones of the protruding edge portions 10*d* can be reduced. Thus, the water can be made to drop from the protruding edge portions 10*d* more easily. Likewise, the interval between adjacent ones of the protruding edge portions 10*e* in the direction of parallel arrangement of the plurality of fins 10 can be increased to approximately twice the interval between adjacent ones of the fins 10. Accordingly, the surface tension of the water that is present between adjacent ones of the protruding edge portions 10*e* can be reduced. Thus, the water can be made to drop from the protruding edge portions 10*e* more easily.

Embodiment 7

Figure 15:
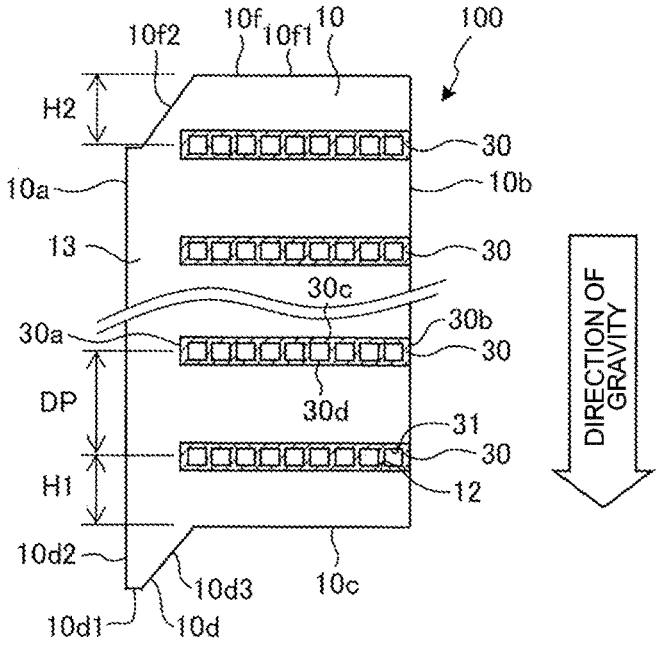
FIG. 15 is a cross-sectional view illustrating a relevant part of a heat exchanger 100 according to Embodiment 7 of the present disclosure.
Figure 16:
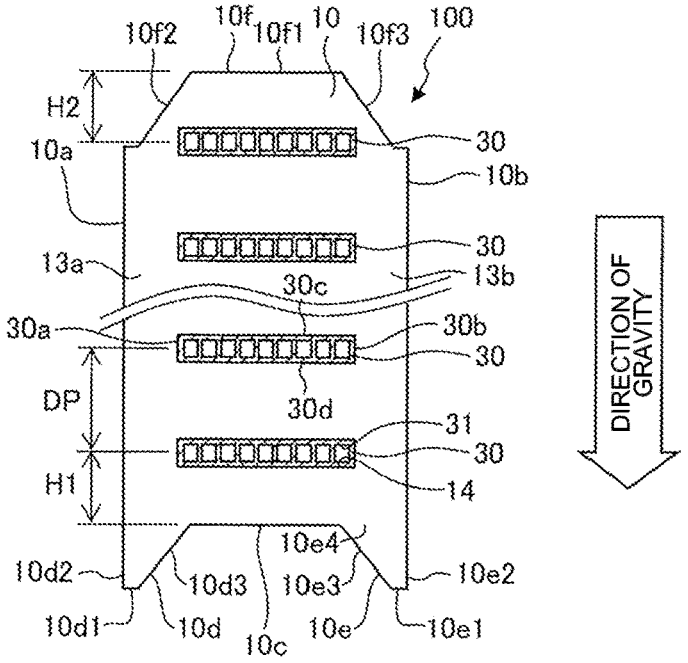
FIG. 16 is a cross-sectional view illustrating a relevant part of a heat exchanger 100 according to a modification of Embodiment 7 of the present disclosure.

A heat exchanger according to Embodiment 7 of the present disclosure will now be described. FIG. 15 is a cross-sectional view illustrating a relevant part of a heat exchanger 100 according to Embodiment 7. FIG. 15 and FIG. 16 to be referred to below illustrate a part near the upper end and a part near the lower end of the fin 10. Elements having the same functions and effects as those described in any of Embodiments 1 to 6 are denoted by corresponding ones of the reference signs used therein, and description of such elements is omitted.

As illustrated in FIG. 15, the configuration of the fin 10 is the same as that of the fin 10 according to Embodiment 1 illustrated in FIG. 3, except the part near the upper end of the fin 10. Specifically, the fin 10 includes, at the lower end thereof, the lower edge portion 10*c* positioned below the flat tubes 30, and the protruding edge portion 10*d* positioned below the water guide portion 13.

The fin 10 further includes an upper edge portion 10*f*, the upper edge portion 10*f* being positioned above the flat tubes 30 and the water guide portion 13. The upper edge portion 10*f* forms a part of the outer edge of the fin 10. The upper edge portion 10*f* includes a linear part 10*f*1 and a cut part 10*f*2. The linear part 10*f*1 extends parallel to the lower edge portion 10*c*. The outline of the cut part 10*f*2 is identical to the outline formed of the bottom edge 10*d*1 and the second side edge 10*d*3 of the protruding edge portion 10*d*. Therefore, when seen in the extending direction of the flat tubes 30, the outline of the entirety of the upper edge portion 10*f* is identical to the outline formed of the lower edge portion 10*c* and the protruding edge portion 10*d*.

Here, letting the arrangement pitch of the flat tubes 30 be DP; the height from the lower edge portion 10*c* to the center of the lowest one of the flat tubes 30 in the upper and lower directions be H1; and the height from the center of the highest one of the flat tubes 30 in the upper and lower directions to the linear part 10*f*1 of the upper edge portion 10*f* be H2, the sum of the height H1 and the height H2 is equal to the arrangement pitch DP (H1+H2=DP). Furthermore, the height H1 and the height H2 are each equal to half the arrangement pitch DP (H1=H2=DP/2).

FIG. 16 is a cross-sectional view illustrating a relevant part of a heat exchanger 100 according to a modification of Embodiment 7. As illustrated in FIG. 16, the configuration of the fin 10 is the same as that of the fin 10 according to Embodiment 3 illustrated in FIG. 8, except the part near the upper end of the fin 10. Specifically, the fin 10 includes, at the lower end thereof, the lower edge portion 10*c* positioned below the flat tubes 30, the protruding edge portion 10*d* positioned below the first water guide portion 13*a*, and the protruding edge portion 10*e* positioned below the second water guide portion 13*b*.

The fin 10 further includes an upper edge portion 10*f*, the upper edge portion 10*f* being positioned above the flat tubes 30 and the water guide portion 13. The upper edge portion 10*f* includes a linear part 10*f*1, a cut part 10*f*2, and a cut part 10*f*3. The linear part 10*f*1 extends parallel to the lower edge portion 10*c*. The outline of the cut part 10*f*2 is identical to the outline formed of the bottom edge 10*d*1 and the second side edge 10*d*3 of the protruding edge portion 10*d*. The outline of the cut part 10*f*3 is identical to the outline formed of the bottom edge 10*e*1 and the second side edge 10*e*3 of the protruding edge portion 10*e*. Therefore, the outline of the entirety of the upper edge portion 10*f* is identical to the outline formed of the lower edge portion 10*c*, the protruding edge portion 10*d*, and the protruding edge portion 10*e*.

As with the case of the fin 10 illustrated in FIG. 15, the sum of the height H1 from the lower edge portion 10*c* to the center of the lowest one of the flat tubes 30 in the upper and lower directions and the height H2 from the center of the highest one of the flat tubes 30 in the upper and lower directions to the linear part 10*f*1 of the upper edge portion 10*f* is equal to the arrangement pitch DP of the flat tubes 30 (H1+H2=DP). Furthermore, the height H1 and the height H2 are each equal to half the arrangement pitch DP (H1=H2=DP/2).

As described above, in the heat exchanger 100 according to Embodiment 7, each of the plurality of fins 10 includes the upper edge portion 10*f*, the upper edge portion 10*f* being positioned above the flat tubes 30 and the water guide portion 13. When seen in the extending direction of the flat tubes 30, the outline of the upper edge portion 10*f* is identical to the outline formed of the lower edge portion 10*c* and the protruding edge portion 10*d*. In general, a plurality of fins 10 are manufactured by cutting a long metal plate by a press. In the above configuration, since the outline of the upper edge portion 10*f* is identical to the outline formed of the lower edge portion 10*c* and the protruding edge portion 10*d*, the amount of material to be disposed of in the process of manufacturing the plurality of fins 10 can be reduced. Therefore, the yield of the fins 10 can be improved. Consequently, the manufacturing cost of the heat exchanger 100 can be reduced.

Furthermore, in Embodiment 7, the height H1 and the height H2 are each equal to half the arrangement pitch DP (H1=H2=DP/2). Such a configuration can prevent a reduction in the height of the fin 10 between the lower edge portion 10*c* and the lowest one of the cuts 12 or through-holes 14 or in the height of the fin 10 between the highest one of the cuts 12 or through-holes 14 and the upper edge portion 10*f*. Therefore, the warp in the fin 10 that may occur in the cutting process performed on the press can be reduced.

Embodiment 8

Figure 17:
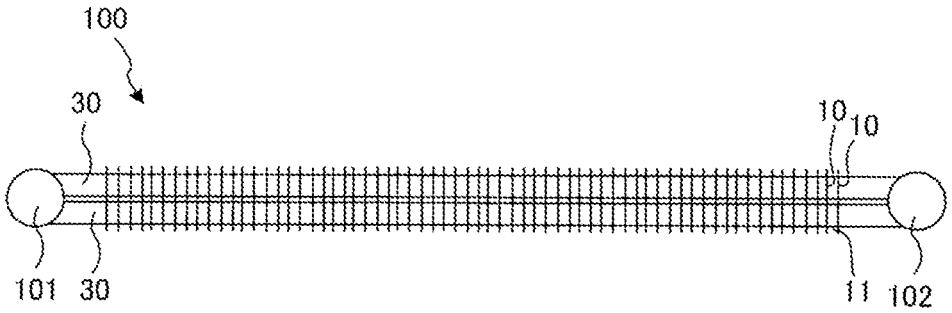
FIG. 17 is a top view illustrating a configuration of a heat exchanger 100 according to Embodiment 8 of the present disclosure.
Figure 18:
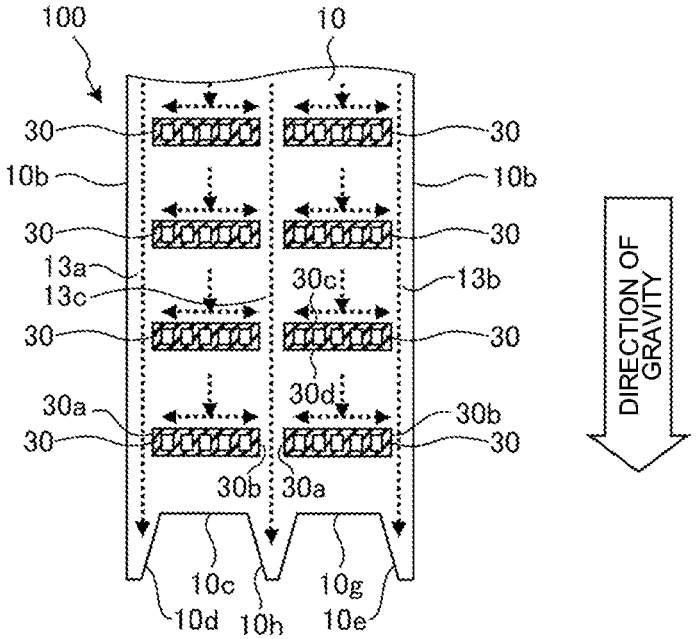
FIG. 18 is a cross-sectional view illustrating a relevant part of the heat exchanger 100 according to Embodiment 8 of the present disclosure.

A heat exchanger according to Embodiment 8 of the present disclosure will now be described. FIG. 17 is a top view illustrating a configuration of a heat exchanger 100 according to Embodiment 8. FIG. 18 is a cross-sectional view illustrating the configuration of the heat exchanger 100 according to Embodiment 8. Elements having the same functions and effects as those described in any of Embodiments 1 to 7 are denoted by corresponding ones of the reference signs used therein, and description of such elements is omitted.

As illustrated in FIGS. 17 and 18, the plurality of flat tubes 30 are arranged in two rows that are adjacent to each other in the direction of airflow. In Embodiment 8, the direction of airflow may be either the rightward or leftward direction in FIG. 18. The fins 10 each have a third water guide portion 13*c* on each of the front and back surfaces thereof between a set of the second end portions 30*b* of the flat tubes 30 in the left row in FIG. 18 and a set of the first end portions 30*a* of the flat tubes 30 in the right row in FIG. 18. The third water guide portion 13*c* has a band shape extending in the upper and lower directions. As with the first water guide portion 13*a* and the second water guide portion 13*b*, the third water guide portion 13*c* forms a linear passage that downwardly guides water.

The fin 10 includes, at the lower end thereof, a lower edge portion 10*c* positioned below the flat tubes 30 in the left row, a lower edge portion 10*g* positioned below the flat tubes 30 in the right row, a protruding edge portion 10*d* positioned below the first water guide portion 13*a*, a protruding edge portion 10*e* positioned below the second water guide portion 13*b*, and a protruding edge portion 10*h* positioned below the third water guide portion 13*c*. The lower edge portion 10*c* is positioned between the protruding edge portion 10*d* and the protruding edge portion 10*h*. The lower edge portion 10*g* is positioned between the protruding edge portion 10*h* and the protruding edge portion 10*e*.

According to Embodiment 8, a heat exchanger 100 including a plurality of rows of flat tubes 30 also produces the advantageous effects produced in any of Embodiments 1 to 7.

Embodiment 9

Figure 19:
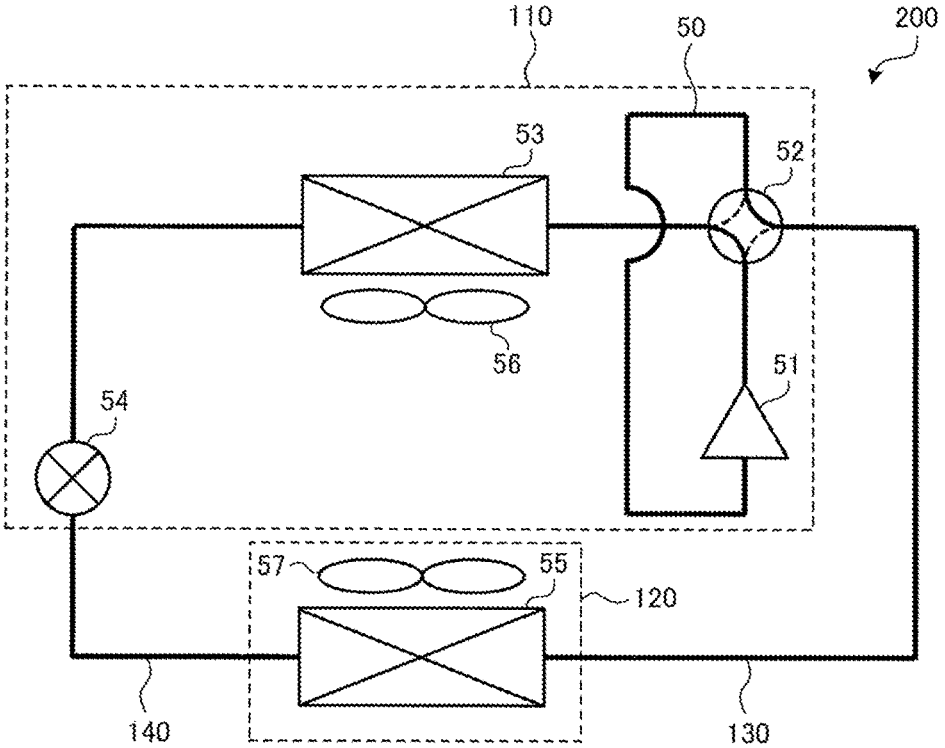
FIG. 19 is a refrigerant circuit diagram illustrating a configuration of a refrigeration cycle apparatus 200 according to Embodiment 9 of the present disclosure.

A refrigeration cycle apparatus according to Embodiment 9 of the present disclosure will now be described. FIG. 19 is a refrigerant circuit diagram illustrating a configuration of a refrigeration cycle apparatus 200 according to Embodiment 9. In Embodiment 9, an air-conditioning apparatus is exemplified as the refrigeration cycle apparatus 200. As illustrated in FIG. 19, the refrigeration cycle apparatus 200 includes a refrigeration cycle circuit 50 through which refrigerant is made to circulate. The refrigeration cycle circuit 50 includes a compressor 51, a four-way valve 52, an outdoor heat exchanger 53, an expansion valve 54, and an indoor heat exchanger 55, which are all connected to one another by refrigerant pipes to form a loop. The refrigeration cycle apparatus 200 further includes an outdoor fan 56 that supplies air to the outdoor heat exchanger 53, and an indoor fan 57 that supplies air to the indoor heat exchanger 55. The refrigeration cycle apparatus 200 executes a refrigeration cycle in which the activation of the compressor 51 makes the refrigerant to circulate through the refrigeration cycle circuit 50 while undergoing phase change. In the outdoor heat exchanger 53, heat is exchanged between the refrigerant as the internal fluid and the air supplied from the outdoor fan 56. In the indoor heat exchanger 55, heat is exchanged between the refrigerant as the internal fluid and the air supplied from the indoor fan 57. At least one of the outdoor heat exchanger 53 and the indoor heat exchanger 55 includes the heat exchanger 100 according to any of Embodiments 1 to 8.

The refrigeration cycle apparatus 200 includes an outdoor unit 110 and an indoor unit 120. The outdoor unit 110 is a heat exchanger unit in which the compressor 51, the four-way valve 52, the outdoor heat exchanger 53, the expansion valve 54, and the outdoor fan 56 are housed. The indoor unit 120 is a heat exchanger unit in which the indoor heat exchanger 55 and the indoor fan 57 are housed. The outdoor unit 110 and the indoor unit 120 are connected to each other by a gas pipe 130 and a liquid pipe 140, each of which forms a part of a refrigerant pipe.

A cooling operation of the refrigeration cycle apparatus 200 will now be described as an exemplary operation. In the cooling operation, the four-way valve 52 is set such that the refrigerant discharged from the compressor 51 flows into the outdoor heat exchanger 53. The refrigerant as high-pressure gas discharged from the compressor 51 flows through the four-way valve 52 into the outdoor heat exchanger 53. In the cooling operation, the outdoor heat exchanger 53 functions as a condenser. Specifically, in the outdoor heat exchanger 53, heat is exchanged between the refrigerant flowing therein and the outdoor air supplied from the outdoor fan 56, whereby the refrigerant transfers heat of condensation to the outdoor air. Consequently, the gas refrigerant having flowed into the outdoor heat exchanger 53 is condensed into high-pressure liquid refrigerant.

The liquid refrigerant discharged from the outdoor heat exchanger 53 is decompressed by the expansion valve 54 into low-pressure two-phase refrigerant. The two-phase refrigerant discharged from the expansion valve 54 flows through the liquid pipe 140 into the indoor heat exchanger 55. In the cooling operation, the indoor heat exchanger 55 functions as an evaporator. Specifically, in the indoor heat exchanger 55, heat is exchanged between the refrigerant flowing therein and the indoor air supplied from the indoor fan 57, whereby the refrigerant receives heat of evaporation from the indoor air. Consequently, the two-phase refrigerant having flowed into the indoor heat exchanger 55 is evaporated into low-pressure gas refrigerant. The indoor air passing through the indoor heat exchanger 55 is cooled by exchanging heat with the refrigerant. The gas refrigerant discharged from the indoor heat exchanger 55 flows through the gas pipe 130 and the four-way valve 52 into the compressor 51. The gas refrigerant taken into the compressor 51 is compressed into high-pressure gas refrigerant. In the cooling operation, the above refrigeration cycle is repeated continuously. In the heating operation, description of which is omitted herein, the four-way valve 52 is set to change the direction of refrigerant flow, whereby the outdoor heat exchanger 53 functions as an evaporator, while the indoor heat exchanger 55 functions as a condenser.

Figure 20:
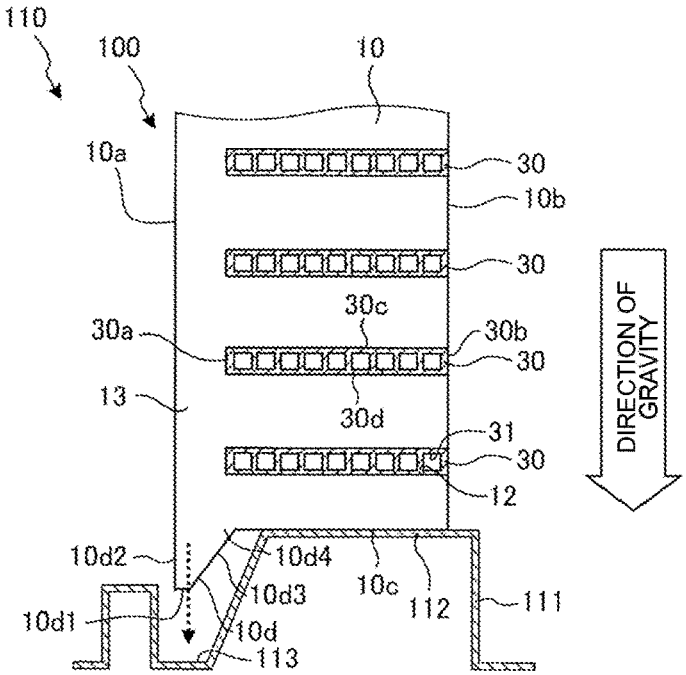
FIG. 20 is a cross-sectional view illustrating a relevant part of an outdoor unit 110 included in the refrigeration cycle apparatus 200 according to Embodiment 9 of the present disclosure.

FIG. 20 is a cross-sectional view illustrating a relevant part of the outdoor unit 110 included in the refrigeration cycle apparatus 200 according to Embodiment 9. As illustrated in FIG. 20, the outdoor unit 110 includes a bottom plate 111 at the bottom thereof. The bottom plate 111 is obtained by bending a steel plate. The surface of the bottom plate 111 may be coated with an anticorrosion resin film. The bottom plate 111 includes a heat-exchanger-supporting portion 112 forming an upward protrusion. The heat-exchanger-supporting portion 112 supports the bottom of the heat exchanger 100, that is, the lower edge portions 10*c* of the fins 10. The bottom plate 111 further includes a drain channel 113 forming a downward protrusion. The drain channel 113 adjoins the heat-exchanger-supporting portion 112. The drain channel 113 serves as a channel for water drained from the heat exchanger 100. The heat exchanger 100 is installed such that the protruding edge portions 10*d* of the fins 10 are positioned right above the drain channel 113.

In Embodiment 9, water to be drained from the heat exchanger 100 is gathered at the protruding edge portions

10*d*, which are each a part of the fin 10 in the widthwise direction, and drops therefrom. Therefore, the width of the drain channel 113 can be reduced. Thus, the water can be drained along the drain channel 113 while being prevented from spreading in the widthwise direction of the drain channel 113. Hence, the amount of water that may remain in the drain channel 113 can be reduced.

As described above, the refrigeration cycle apparatus 200 according to Embodiment 9 includes the heat exchanger 100 according to any of Embodiments 1 to 8. With such a configuration, a refrigeration cycle apparatus exhibiting improved drainability from the heat exchanger 100 can be realized.

While Embodiments 1 to 9 each concern a heat exchanger 100 including fins 10 whose longitudinal direction is parallel to the direction of gravity, the present disclosure is not limited to such a case. The longitudinal direction of the fins 10 may be inclined relative to the direction of gravity. That is, the "upper and lower directions" referred to herein includes not only directions parallel to the direction of gravity but also directions inclined relative to the direction of gravity that can be regarded as upper and lower directions in a technically practical sense.

Embodiments 1 to 9 and the modifications thereof may be combined in any way.

The invention claimed is:

1. A heat exchanger comprising:

a plurality of fins arranged in parallel with each other and extending along upper and lower directions; and a flat tube extending crosswise to the plurality of fins, each of the plurality of fins having a first side edge portion and a second side edge portion, the first side edge portion and the second side edge portion extending along the upper and lower directions, the flat tube having end portions in the longitudinal axis direction of the flat tube in a cross-section perpendicular to the extending direction of the flat tube, the end portions comprising a first end portion and a second end portion, the first end portion being positioned closer to the first side edge portion than the second end portion is to the first side edge portion, each of the plurality of fins including at least one water guide portion formed at at least one of a position between the first side edge portion and the first end portion, and a position between the second side edge portion and the second end portion, the water guide portion extending in the upper and lower directions, a lower edge portion positioned below the flat tube in the upper and lower directions, and a protruding edge portion positioned below the water guide portion in the upper and lower directions, and protruding downwardly relative to the lower edge portion, wherein letting a width of the protruding edge portion at an upper end be W2 and a width of the water guide portion be W3, a relationship of W3≤W2 is satisfied.

2. A heat exchanger comprising:

a plurality of fins arranged in parallel with each other and extending along upper and lower directions; and a flat tube extending crosswise to the plurality of fins, each of the plurality of fins having a first side edge portion and a second side edge portion, the first side edge portion and the second side edge portion extending along the upper and lower directions, the flat tube having end portions in the longitudinal axis direction of the flat tube in a cross-section perpendicular to the extending direction of the flat tube, the end portions comprising a first end portion and a second end portion, the first end portion being positioned closer to the first side edge portion than the second end portion is to the first side edge portion, each of the plurality of fins including at least one water guide portion formed at at least one of a position between the first side edge portion and the first end portion, and a position between the second side edge portion and the second end portion, the water guide portion extending in the upper and lower directions, a lower edge portion positioned below the flat tube in the upper and lower directions, and a protruding edge portion positioned below the water guide portion in the upper and lower directions, and protruding downwardly relative to the lower edge portion, wherein letting a width of the protruding edge portion at a lower end be W1 and a width of the protruding edge portion at an upper end be W2, a relationship of W1≤W2 is satisfied.

3. The heat exchanger of claim 1, wherein letting a width of the protruding edge portion at an upper end be W2 and a width of the water guide portion be W3, a relationship of W3≤W2 is satisfied.

4. The heat exchanger of claim 1, wherein the flat tube has a flat upper surface, and wherein the upper surface is inclined by descending toward the water guide portion.

5. The heat exchanger of claim 1, wherein the water guide portion includes a first water guide portion provided between the first side edge portion and the first end portion, and a second water guide portion provided between the second side edge portion and the second end portion, wherein the flat tube has a flat upper surface, wherein the upper surface is inclined by descending toward one of the first water guide portion and the second water guide portion, wherein the protruding edge portion is provided below the one of the first water guide portion and the second water guide portion, wherein the lower edge portion reaches a position below an other of the first water guide portion and the second water guide portion, and wherein the lower edge portion is inclined by descending toward the protruding edge portion.

6. The heat exchanger of claim 1, wherein the plurality of fins include a first fin and a second fin adjacent to the first fin at an interval, wherein the water guide portion includes a first water guide portion provided between the first side edge portion and the first end portion, and a second water guide portion provided between the second side edge portion and the second end portion, wherein the protruding edge portion of the first fin is provided below one of the first water guide portion and the second water guide portion, and wherein the protruding edge portion of the second fin is provided below an other of the first water guide portion and the second water guide portion.

7. The heat exchanger of claim 1, wherein each of the plurality of fins includes an upper edge portion, the upper edge portion being positioned above the flat tube and the water guide portion, and wherein when seen in an extending direction of the flat tube, an outline of the upper edge portion is identical to an outline formed of the lower edge portion and the protruding edge portion.

8. A refrigeration cycle apparatus comprising the heat exchanger of claim 1.

* * * * *